US007543643B2

(12) United States Patent
Hill

(10) Patent No.: US 7,543,643 B2
(45) **Date of Patent: *Jun. 9, 2009**

(54) DOWN HOLE OIL AND GAS WELL HEATING SYSTEM AND METHOD FOR DOWN HOLE HEATING OF OIL AND GAS WELLS

(76) Inventor: William L. Hill, 23 Estates Ct., Longview, TX (US) 75605

( * ) Notice: Subject to any disclaimer, the term of this patent is extended or adjusted under 35 U.S.C. 154(b) by 239 days.

This patent is subject to a terminal disclaimer.

(21) Appl. No.: 11/296,202

(22) Filed: Dec. 6, 2005

(65) Prior Publication Data

US 2008/0047711 A1 Feb. 28, 2008

Related U.S. Application Data

(63) Continuation-in-part of application No. 11/041,525, filed on Jan. 24, 2005, now Pat. No. 7,363,979, which is a continuation-in-part of application No. 10/763,568, filed on Jan. 23, 2004, now Pat. No. 7,069,993, which is a continuation-in-part of application No. 10/037,754, filed on Oct. 22, 2001, now Pat. No. 6,681,859.

(51) Int. Cl.
*E21B 36/04* (2006.01)

(52) U.S. Cl. ..... 166/302; 166/60; 392/301

(58) Field of Classification Search ..... 166/302, 166/57, 60, 65.1; 392/301, 305
See application file for complete search history.

(56) References Cited

U.S. PATENT DOCUMENTS

| | | | |
|---|---|---|---|
| 522,737 | A | 7/1894 | Lucock |
| 782,233 | A | 2/1905 | Gardner |
| 806,039 | A | 11/1905 | Williamson et al. |
| 972,308 | A | 10/1910 | Williamson |
| 1,140,982 | A | 5/1915 | Huff |
| 1,368,404 | A | 2/1921 | Loftus |
| 1,450,658 | A | 4/1923 | Warnick |
| 1,690,994 | A | 11/1928 | Powell |
| 2,757,738 | A | 8/1956 | Ritchey |

(Continued)

FOREIGN PATENT DOCUMENTS

| | | | |
|---|---|---|---|
| EP | 1751394 | A | 2/2007 |

(Continued)

OTHER PUBLICATIONS

Kemlon Products and Development: "http://www.kemlon.com/catalogs/power/techinfo/techinfo.htm" (printed Jan. 20, 2005).

*Primary Examiner*—Jennifer H Gay
*Assistant Examiner*—Daniel P Stephenson
(74) *Attorney, Agent, or Firm*—Cox Smith Matthews Incorporated

(57) ABSTRACT

A down hole heating system for use with oil and gas wells which exhibit less than optimally achievable flow rates because of high oil viscosity and/or blockage by paraffin (or similar meltable petroleum byproducts). The heating unit the present invention includes shielding to prevent physical damage and shortages to electrical connections within the heating unit while down hole (a previously unrecognized source of system failures in prior art systems). The over-all heating system also includes heat retaining components to focus and contain heat in the production zone to promote flow to, and not just within, the production tubing.

18 Claims, 3 Drawing Sheets

U.S. PATENT DOCUMENTS

| | | | |
|---|---|---|---|
| 3,137,347 | A | 6/1964 | Parker |
| 3,220,479 | A | 11/1965 | Ortloff et al. |
| 3,379,256 | A | 4/1968 | Alexander et al. |
| 3,857,776 | A | 12/1974 | Titus et al. |
| 4,415,034 | A | 11/1983 | Bouck |
| 4,570,715 | A | 2/1986 | Van Meurs et al. |
| 4,627,490 | A | 12/1986 | Moore |
| 4,694,907 | A | 9/1987 | Stahl et al. |
| 4,988,389 | A | 1/1991 | Adamache et al. |
| 5,060,287 | A | 10/1991 | Van Egmond |
| 5,120,935 | A | 6/1992 | Nenniger |
| 5,247,994 | A | 9/1993 | Nenniger |
| 5,282,508 | A | 2/1994 | Ellingsen et al. |
| 5,361,845 | A | 11/1994 | Jamaluddin et al. |
| 5,433,271 | A | 7/1995 | Vinegar et al. |
| 5,517,593 | A | 5/1996 | Nenniger et al. |
| 5,539,853 | A | 7/1996 | Jamaluddin et al. |
| 5,621,844 | A | 4/1997 | Bridges |
| 5,713,415 | A | 2/1998 | Bridges |
| RE35,891 | E | 9/1998 | Jamaluddin et al. |
| 6,269,876 | B1 | 8/2001 | De Rouffignac et al. |
| 6,353,706 | B1 | 3/2002 | Bridges |
| 6,681,859 | B2 | 1/2004 | Hill |
| 7,069,993 | B2 | 7/2006 | Hill |
| 2005/0173120 | A1 | 8/2005 | Hill |

FOREIGN PATENT DOCUMENTS

| | | | |
|---|---|---|---|
| GB | 1537062 | | 12/1978 |
| WO | 2005072289 | A2 | 8/2005 |
| WO | 2005072289 | A3 | 8/2005 |
| WO | WO2007/117316 | A3 | 2/2008 |

DOWN HOLE OIL AND GAS WELL HEATING SYSTEM AND METHOD FOR DOWN HOLE HEATING OF OIL AND GAS WELLS

CITATION TO PRIOR APPLICATION

This is a continuation-in-part with respect to U.S. patent application, Ser. No. 11/041,525, filed on Jan. 24, 2005; now U.S. Pat. No. 7,363,979 which is a continuation-in-part with respect to U.S. patent application, Ser. No. 10/763,568, filed on Jan. 23, 2004, now U.S. Pat. No. 7,069,993; which is a continuation-in-part with respect to U.S. patent application Ser. No. 10/037,754, filed on Oct. 22, 2001, now U.S. Pat. No. 6,681,859.

BACKGROUND OF THE INVENTION

1. Field of the Invention

The present invention relates to systems and methods for producing or delivering heat at or near the down hole end of production tubing of a producing oil or gas well for improving production therefrom.

2. Background Information

Free-flowing oil is increasingly difficult to find, even in oil wells that once had very good flow. In some cases, good flowing wells simply "clog up" with paraffin. In other cases, the oil itself in a given formation is of a viscosity that it simply will not flow (or will flow very slowly) under naturally ambient temperatures.

Because the viscosity of oil and paraffin have an inverse relationship to their temperatures, the solution to non-flowing or slow flowing oil wells would seem fairly straight forward—somehow heat the oil and/or paraffin. However, effectively achieving this objective has proven elusive for many years.

In the context of gas wells, another phenomena—the buildup of iron oxides and other residues that can obstruct the free flow of gas through the perforations, through the tubing, or both—creates a need for effective down hole heating.

Down hole heating systems or components for oil and gas wells are known (hereafter, for the sake of brevity, most wells will simply be referred to as "oil wells" with the understanding that certain applications will apply equally well to gas wells). In addition, certain treatments (including "hot oil treatments") for unclogging no-flow or slow-flow oil wells have long been in use. For a variety of reasons, the existing technologies are very much lacking in efficacy and/or long-term reliability.

The present invention addresses two primary shortcomings that the inventor has found in conventional approaches to heating oil and paraffin down hole: (1) the heat is not properly focused where it needs to be; and (2) existing down hole heaters fail for lack of design elements which would protect electrical components from chemical or physical attack while in position.

The present inventor has discovered that existing down hole heaters inevitably fail because their designers do not take into consideration the intense pressures to which the units will be exposed when installed. Such pressure forces liquids (including highly conductive salt water) past the casings of conventional heating units and causes electrical shorts and corrosion. Designers with whom the present inventor has discussed heater failures have uniformly failed to recognize the root cause of the problem—lack of adequate protection for the heating elements and their electrical connections. The down hole heating unit of the present invention addresses this shortcoming of conventional heating units.

Research into the present design also reveals that designers of existing heaters and installations have overlooked crucial features of any effective down hole heater system: (1) it must focus heat in such a way that the production zone of the formation itself is heated; and (2) heat (and with it, effectiveness) must not be lost for failure to insulate heating elements from up hole components which "draw" heat away from the crucial zones by conduction.

However subtle the distinctions between the present design and those of the prior art might at first appear, actual field applications of the present down hole heating system have yielded oil well flow rate increases which are multiples of those realized through use of presently available down hole heating systems. The monetary motivations for solving slow-flow or no-flow oil well conditions are such that, if modifying existing heating units to achieve the present design were obvious, producers would not have spent millions of dollars on ineffective down hole treatments and heating systems (which they have done), nor lost millions of dollars in production for lack of the solutions to long-felt problems that the present invention provides (which they have also done).

SUMMARY OF THE INVENTION

It is an object of the present invention to provide an improved down hole heating system for use in conditioning oil and gas wells for increased flow, when such flow is impeded because of viscosity and/or paraffin blockage conditions.

It is another object of the present invention to provide an improved design for down hole heating systems which has the effect of more effectively focusing heat where it is most efficacious in improving oil or gas flow in circumstances when such flow is impeded because of oil viscosity and/or paraffin blockage conditions.

It is another object of the present invention to provide an improved design for down hole heating systems for oil and gas wells which design renders the heating unit useful for extended periods of time without interruption for costly repairs because of damage or electrical shorting caused by unit invasion by down hole fluids.

It is another object of the present invention to provide an improved method for down hole heating of oil and gas wells for increasing flow, when such flow is impeded because of viscosity and/or paraffin blockage conditions.

In satisfaction of these and related objects, the present invention provides a down hole heating system for use with oil and gas wells which exhibit less than optimally achievable flow rates because of high oil viscosity and/or blockage by paraffin (or similar meltable petroleum byproducts). The system of the present invention, and the method of use thereof, provides two primary benefits: (1) the involved heating unit is designed to overcome a previously unrecognized problem which leads to frequent failure of prior art heating units—unit invasion by down hole heating units with resulting physical damage and/or electrical shortages; and (2) the system is designed to focus and contain heat in the production zone to promote flow to, and not just within, the production tubing.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENT

Figure 1:
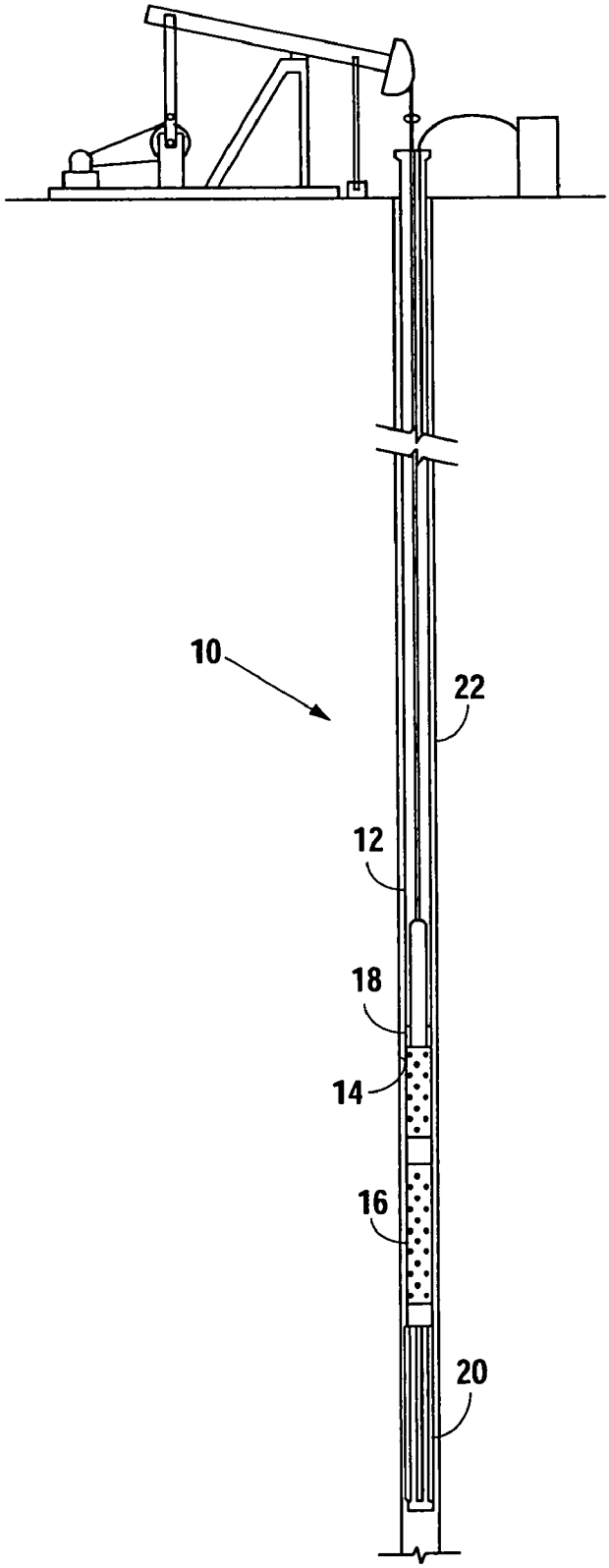
FIG. 1 is an elevational view of a producing oil well with the components of the present down hole heating system installed.

Referring to FIG. 1, the complete down hole heating system of the present invention is generally identified by the reference numeral 10. System 10 includes production tubing 12 (the length of which depends, of course, on the depth of the well), a heat insulating packer 14, perforated tubing 16, a stainless steel tubing collar 18, and a heating unit 20.

Heat insulating packer 14 and stainless steel collars 18 are included in their stated form for "containing" the heat from heating unit 20 within the desired zone to the greatest practical degree. Were it not for these components, the heat from heating unit 20 would (like the heat from conventional down hole heater units) convect and conduct upward in the well bore and through the production tubing, thereby essentially directing much of the heat away from the area which it is most needed—the production zone.

Perhaps, it goes without saying that oil that never reaches the pump will never be produced. However, this truism seems to have escaped designers of previous down-hole heating schemes, the use of which essentially heats oil only as it enters the production tubing, without effectively heating it so that it will reach the production tubing in the first place. Largely containing the heat below the level of the junction between the production tubing 12 and the perforated tubing 16, as is achieved through the current design, has the effect of focusing the heat on the production formation itself. This, in turn, heats oil and paraffin in situ and allows it to flow to the well bore for pumping, thus "producing" first the viscous materials which are impeding flow, and then the desired product of the well (oil or gas). Stainless steel is chosen as the material for the juncture collars at and below the joinder of production tubing 12 and perforate tubing 16 because of its limited heat conductive properties.

Figure 2:
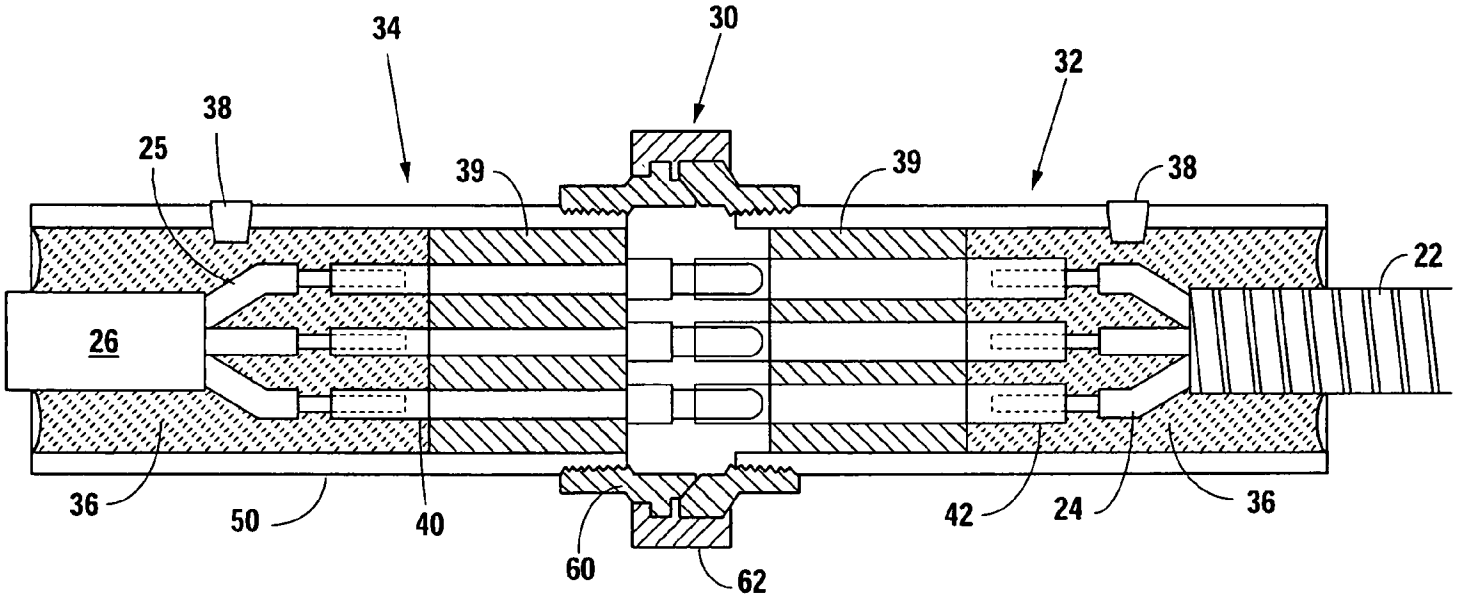
FIG. 2 is cross-section view of the heating unit connector of the preferred embodiment of the present invention.

Physical and chemical attack of the electrical connections between the power leads and the heater rods of conventional heating systems, as well as shorting of electrical circuits because of invasion of heater units by conductive fluids is another problem of the present art to which the present invention is addressed. Referring to FIG. 2, the present inventor has discovered that, to prevent the aforementioned electrical problems, the internal connection for a down hole heating unit must be impenetrably shielded from the pressures and hostile chemical agents which surround the unit in the well bore.

The patent which serves as a priority basis for the present invention discloses an embodiment that tremendously increases down hole wiring connection integrity. However, referring to FIG. 2, the present invention is even better at preventing the aforementioned problems. In fact, the unique combination of materials, particularly ceramic cement, a highly durable insulation means, and the use of connector pins, provides protection against shortage and other connection damage not previously possible. Such an improvement is of great significance as the internal connection for a down hole heating unit must be impenetrably shielded from the pressures and hostile chemical agents that surround the unit in the well bore.

Referring in combination to FIG. 1 and FIG. 2, heating unit 20 includes heating unit connector 30. Heating unit connecter 30 is largely responsible for ensuring the integrity of the connection between surface wiring leads 24 and heater rod wiring leads 25. The electrical current for heater rod 26 is supplied by cable 22, which runs down the exterior of production tubing 12 and connects to surface wiring leads 24 at the upper end of heating unit 20.

As shown in FIG. 2, heating unit connector 30 is comprised of two substantially identical pieces. The upper piece (nearest surface), generally designated by numeral 32, houses surface wiring leads 24. The lower piece (nearest downhole), generally designated by numeral 34, houses heater rod wiring leads 25 and heater rod 26.

Heater unit connector 30 also contains two connector pins (male and female), wherein each connector pin has a distal and medial end. The union between male connector pins 40 and female connector pins 42 occurs about the medial end of each connector piece 40 and 42, and further about the medial portion of heater unit connector 30. Male connector pins 40, have female receptacles that receive male extensions from heater rod wiring leads 25. At its medial portion, male connector pins 40 have male extensions that may be plugged into the medial portion of female connector pins 42.

Female connector pins 42 contain female receptacles about both their medial and distal portions. At their distal portion, female connector pins 42 receive male extensions from surface wiring leads 24. At their medial portions, each female connector pin 42 receives a corresponding male connector pin 40. Importantly, the improvements provided by the present invention do not depend on any specific pin connector configuration. In fact, as will be apparent to those skilled in the art, different connector pin configurations or different pin types may work equally as well.

Connector pieces 32 and 34 each contain, in their distal portion, a high temperature ceramic-filled region, generally designated by numeral 36. The ceramic cement of region 36 serves to enclose the junction between each connector pin and the respective wiring of each piece. In the preferred embodiment, the high temperature ceramic cement is an epoxy material which is available as Sauereisen Cement #1, which may be obtained from the Industrial Engineering and Equipment Company ("INDEECO") of St. Louis, Mo., U.S.A. However, as will be apparent to those skilled in the art, other materials may serve to perform the desired functions.

Upon drying, the high temperature ceramic cement of region 36 becomes an essentially glass-like substance. Shrinkage is associated with the cement as it dries. As such, in the preferred embodiment, each heater unit connector pieces contains a pipe plug 38. Pipe plug 38 provides an access point through which additional ceramic cement can be injected into each piece, thereby filling any void which develops as the ceramic cement dries. Further, pipe plug 38 may be reversibly sealed to each piece so that epoxy can be injected as needed while the strength of the seal is maintained.

Connector pieces 32 and 34 further contain, in their medial portion, an insulator block region, designated by numeral 39. Insulator region 39 houses each connector pin so that the union between male connector pins 40 and female connector pins 42 is suitably insulated from any outside electrical or chemical agent.

In order to withstand the corrosive chemicals and enormous external pressure, the outer surface of heater unit connector 30 must be incredibly strong. The aforementioned elements of connector 30 are substantially encased in a fitting assembly 50, preferably made of steel ("encasement means"). Each components of assembly 50 is welded with continuous beads, preferably using the "TEG" welding process, to each adjoining component. The TEG welding process is preferred as it allows the seams of joined components to withstand extreme conditions in the well bore. Finally, in the preferred embodiment, the outer surface of connector 30 is comprised of stainless steel.

Each connector piece is secured to the other by fitting assembly 60. Fitting assembly 60 and sealing fitting 62 are, as would be apparent to those skilled in the art, designed to engage one another so as to form a sealed junction. In the preferred embodiment, this union is a standard two inch union that is modified by the "TEG" welding process mentioned above. That is, the union is welded using the TEG process so that it will withstand the extreme environmental condition of the well bore.

The shielding of the electrical connections between surface wiring leads 24 and heater wiring leads 25 is crucial for long-term operation of a down hole heating system of the present invention. Equally important is that power is reliably delivered to that connection. Therefore, solid copper leads with KAPTON insulation are used, such leads being of suitable gauge for carrying the intended 16.5 kilowatt, 480 volt, and associated current for the present system with its 0.475 inch diameter INCOLOY heater rods 26 (also available from INDEECO).

Figure 3:
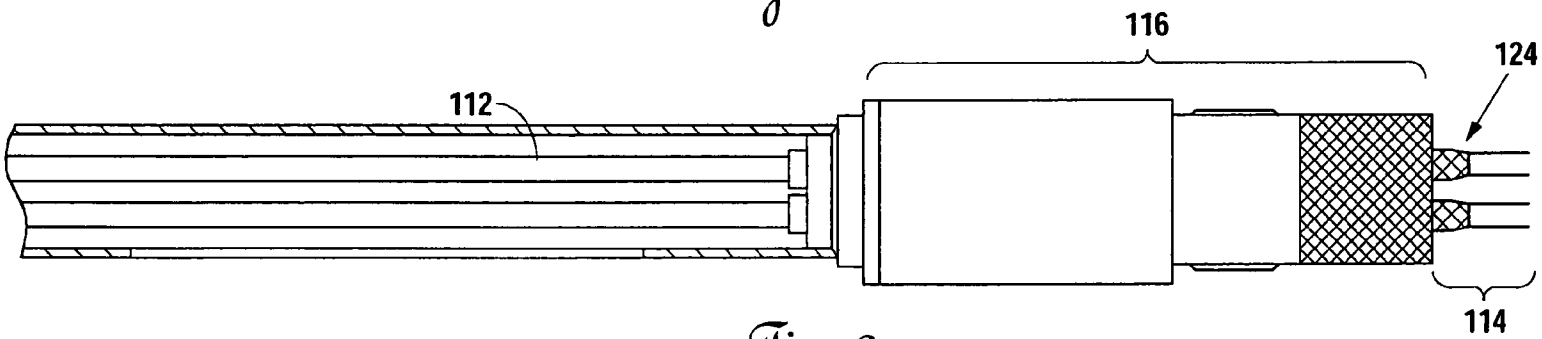
FIG. 3 is a cross-section view of the heating unit connector of an alternative embodiment of the present invention.
Figure 4:
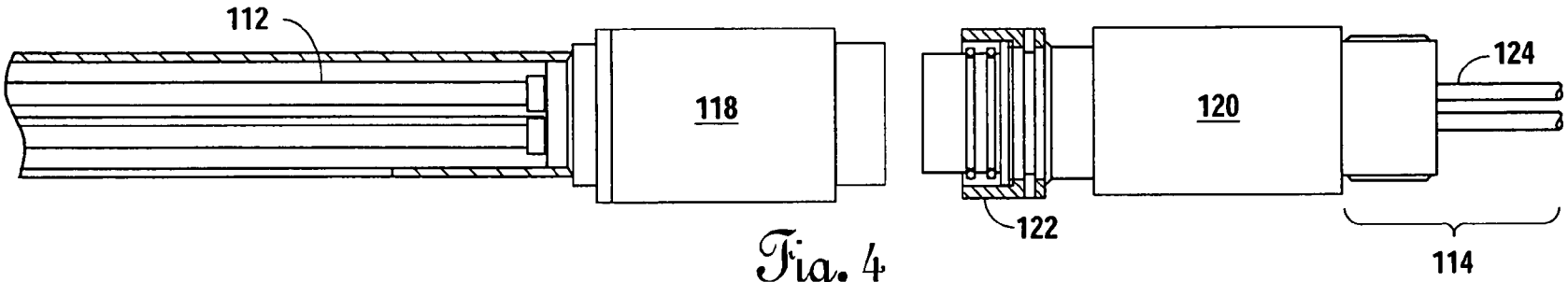
FIG. 4 is a cross-section view of the heating unit connector of a second alternative embodiment of the present invention.
Figure 5:
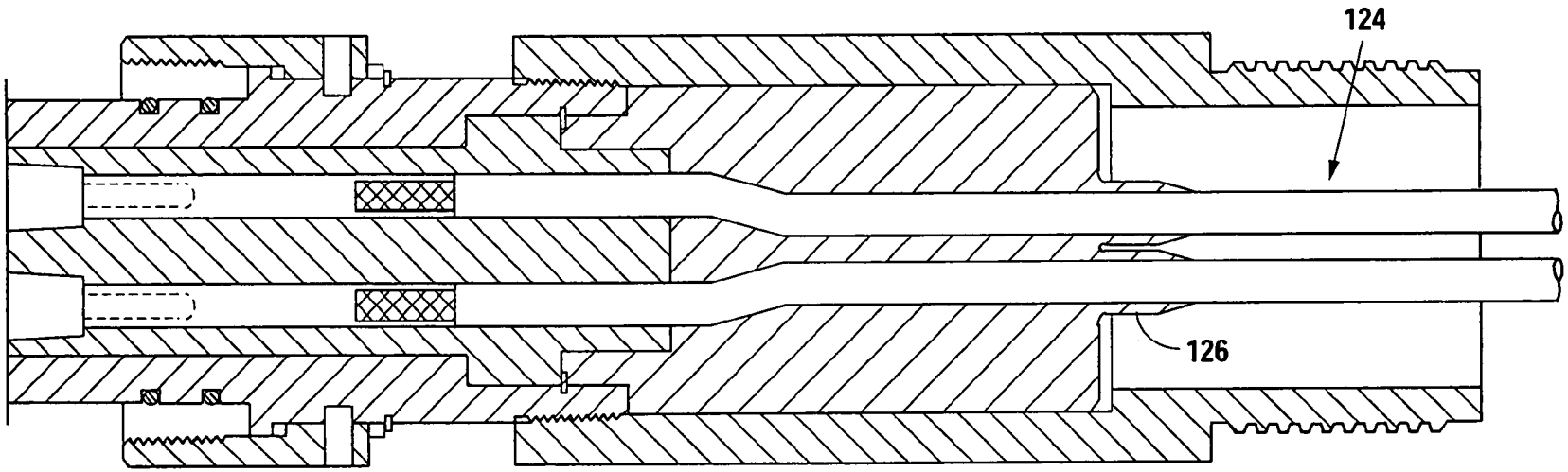
FIG. 5 is a cross-section view of the female segment of the heating unit connector of the second alternative embodiment of the present invention.

Referring to FIGS. 3 and 4, an alternative embodiment of the present invention includes a heater assembly 112 connected to a surface assembly 114 by a connector assembly 116. In one alternative embodiment, connector assembly 116 sealably connects to heater assembly 112 via a welded connection as shown in FIG. 3. Alternatively, as shown in FIG. 4, connector assembly 116 is further characterized by a male connector pin section 118 and a female connector pin section 120. Male connector pin section 118 sealably connects to heater assembly 112 via a welded connection; however, female connector section 120 sealably connects to male connector section 118 via coupling ring 122. In the preferred embodiment, coupling ring 122 is made of aluminum bronze, but coupling ring 122 may also be made of other suitably corrosion resistant materials as known in the art. Referring to FIGS. 3 and 5, in both embodiments, connector assembly 116 is further characterized in its connection to surface assembly 114 by pigtails 124 as generally known in the art. These pigtails are made by vulcanizing a connector portion directly to a length of cable. The pigtail is then spliced to the pump cable. In each alternative embodiment, the connection is further secured by a collar, as known in the art, at location 126.

The general connector arrangement, and other beneficial variations thereof, are known to be manufacture by KEMLON, of Pearland, Tex., U.S.A. These connectors produced at KEMLON are held out as being particularly effective as they can withstand enormous pressures and are known by those skilled in the art to be particularly effective in various hostile environments including subsurface oil wells and high temperature surroundings. Further, sound construction of these connectors makes for especially beneficial use. For instance, these components are made of excellent material, having an alloy steel, cadmium plated bod; a copper, gold plated contact; and KN-01 NEOPRENE standard insulation. In particular, connectors of the SL-5000 series, manufactured by KEMLON are thought to serve as particularly suitable components for the present system.

Various embodiments of the present invention include the method for use of the above-described system for heat treating an oil or gas well for improving well flow. The method includes use of a down hole heating unit with suitably shielded electrical connections substantially as described, along with installation of the heat-retaining elements also as described to properly focus heat on the producing formation.

In addition to the foregoing, it should be understood that the present method may also be utilized by substituting cable ("wire line") for the down hole pipe for supporting the heating unit 20 while pipe is pulled from the well bore. In other words, one can heat-treat a well using the presently disclosed apparatuses and their equivalents before re-inserting pipe, such as during other well treatments or maintenance during which pipe is pulled. It is believed that this approach would be particularly beneficial in treating deep gas wells with an iron sulfide occlusion problem.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An apparatus for heating a segment of an oil or gas well bore and surrounding strata comprising:

an electrical resistance heating rod;

an electrical cable for carrying electrical current from an electrical current source to said electrical resistance heating rod;

at least one surface electrical lead having first and second ends, said first end being connected to said electrical cable to form a first electrical junction;

at least one surface connector pin having distal and medial ends, said distal end being connected to said second end of said at least one surface electrical lead to form a second electrical junction;

at least one heating rod electrical lead having first and second ends, said first end of said at least one heating rod electrical lead being connected to said electrical resistance heating rod to form a third electrical junction;

at least one downhole connector pin having distal and medial ends, said distal end of said at least one downhole connector pin being connected to said second end of said at least one heating rod electrical lead to form a fourth electrical junction, wherein said medial end of said at least one downhole connector pin reversibly connects with said medial end of said at least one surface connector pin to form a pin connection, such that electrical current may be carried from said electrical cable to said first electrical junction, said second electrical junction, said pin connection, said third electrical junction, said fourth electrical junction, and said electrical resistance heating rod;

a protective block comprising an upper portion and a lower portion, said upper portion having embedded therein the respective portions of said at least one surface electrical lead and said at least one surface connector pin as connect one to the other, said lower portion having embedded therein the respective portions of said at least one heating rod electrical lead and said at least one downhole connector pin as connect one to the other, each of said upper and lower portions further having a distal section and a medial section, said distal sections of said upper and lower portions containing a moldable material which, when cured, is substantially impervious to pressure and chemical permeation; and a metallic encasement member encasing said protective block and sealingly connecting said upper portion to said lower portion of said protective block via a mechanical coupling that, when said mechanical coupling is coupled, forms a substantially impervious enclosure with said protective block.

2. The apparatus of claim 1 further comprising a perforated production tubing segment having a proximal end which is reversibly engageable to a distal terminus of production tubing string and a distal end which is engageable with said metallic encasement member; and a heat insulating packer in communication with a collar which is engaged with said production tubing string, said heat insulating packer and said collar being located above said perforated production tubing segment, wherein said heat insulating packer and said collar are adapted to focus heat from said electrical resistance heating rod to said segment of said well bore and surrounding strata when placed in said well bore.

3. The apparatus of claim 1 wherein said medial sections of said upper and lower portions of said protective block further comprise an insulated region that substantially encloses said pin connection.

4. The apparatus of claim 1 wherein said metallic encasement member comprises a reversibly sealable aperture through which said moldable material may be repeatedly injected into said protective block.

5. The apparatus of claim 1 wherein said mechanical coupling is threaded.

6. The apparatus of claim 5 wherein said mechanical coupling can be uncoupled.

7. The apparatus of claim 1 wherein said mechanical coupling can be uncoupled.

8. An apparatus for heating a segment of an oil or gas well bore and surrounding strata comprising:

an electrical resistance heating rod disposed within a heater assembly;

an electrical cable for carrying electrical current from an electrical current source to said electrical resistance heating rod;

a connector assembly comprising at least one pigtail, said at least one pigtail being connected to said electrical cable;

said heater assembly being sealingly welded to said connector assembly; and at least one protective block, said at least one protective block being constructed of a moldable material which, when cured, is substantially impervious to pressure and chemical permeation, said at least one protective block being encased by said connector assembly and said heater assembly.

9. The apparatus of claim 8 further comprising a perforated production tubing segment having a proximal end which is reversibly engageable to a distal terminus of production tubing string and a distal end which is engageable with at least one of said heater assembly and said connector assembly; and a heat insulating packer in communication with a collar which is engaged with said production tubing string, said heat insulating packer and said collar being located above said perforated production tubing segment, wherein said heat insulating packer and said collar are adapted to focus heat from said electrical resistance heating rod to said segment of said well bore and surrounding strata when placed in said well bore.

10. The apparatus of claim 8 wherein said at least one protective block comprises an insulated region, said insulated region being encased by at least one of said connector assembly and said heater assembly.

11. The apparatus of claim 8 wherein said heater assembly is sealingly welded to said connector assembly via a TEG welding process.

12. The apparatus of claim 8 wherein a surface assembly is connected to said connector assembly via a collar.

13. An apparatus for heating a segment of an oil or gas well bore and surrounding strata comprising:

an electrical resistance heating rod disposed within a heater assembly;

an electrical cable for carrying electrical current from an electrical current source to said electrical resistance heating rod;

a surface assembly comprising at least one surface pigtail, said at least one surface pigtail being connected to said electrical cable;

a female connector assembly comprising at least one connector pigtail, said at least one connector pigtail being connected to said at least one surface pigtail of said surface assembly, said female connector assembly connecting to said surface assembly via a collar, said female connector assembly further comprising at least one female connector pin having distal and medial ends;

a male connector assembly comprising at least one male connector pin having distal and medial ends, said male connector assembly being sealingly welded to said heater assembly to form a first substantially impervious enclosure, said male connector assembly sealingly connecting to said female connector assembly via a mechanical coupling that, when said mechanical coupling is coupled, forms a second substantially impervious enclosure, said second substantially impervious enclosure enclosing said at least one male connector pin which is reversibly connected with said at least one female connector pin at their respective medial ends to form a pin connection; and at least one protective block, said at least one protective block being constructed of a moldable material which, when cured, is substantially impervious to pressure and chemical permeation, said at least one protective block being encased by said surface assembly, said female connector assembly, said male connector assembly, and said heater assembly.

14. The apparatus of claim 13 further comprising a perforated production tubing segment having a proximal end which is reversibly engageable to a distal terminus of production tubing string and a distal end which is engageable with said surface assembly; and a heat insulating packer in communication with a collar which is engaged with said production tubing string, said heat insulating packer and said collar being located above said perforated production tubing segment, wherein said heat insulating packer and said collar are adapted to focus heat from said electrical resistance heating rod to said segment of said well bore and surrounding strata when placed in said well bore.

15. The apparatus of claim 13 wherein said at least one protective block further comprises an insulated region that substantially encloses said pin connection.

16. The apparatus of claim 13 wherein said mechanical coupling is threaded.

17. The apparatus of claim 16 wherein said mechanical coupling can be uncoupled.

18. The apparatus of claim 13 wherein said mechanical coupling can be uncoupled.

* * * * *